US007175022B2

(12) United States Patent
Ito

(10) Patent No.: US 7,175,022 B2
(45) Date of Patent: Feb. 13, 2007

(54) HINGED-LID PACK FOR RODLIKE SMOKING ARTICLES AND BLANK FOR THE PACK

(75) Inventor: Tatsuya Ito, Tokyo (JP)

(73) Assignee: Japan Tobacco Inc., Tokyo (JP)

( * ) Notice: Subject to any disclaimer, the term of this patent is extended or adjusted under 35 U.S.C. 154(b) by 0 days.

(21) Appl. No.: 11/171,367

(22) Filed: Jul. 1, 2005

(65) Prior Publication Data

US 2005/0236283 A1 Oct. 27, 2005

Related U.S. Application Data

(63) Continuation of application No. PCT/JP04/000390, filed on Jan. 20, 2004.

(30) Foreign Application Priority Data

Jan. 20, 2003 (JP) ..... 2003-011360

(51) Int. Cl.
*B65D 85/10* (2006.01)
*B65D 43/16* (2006.01)
*A24F 15/12* (2006.01)

(52) U.S. Cl. ..... 206/268; 206/273; 229/160.1

(58) Field of Classification Search ..... 206/268, 206/259, 271, 273, 275; 229/146, 160.1
See application file for complete search history.

(56) References Cited

U.S. PATENT DOCUMENTS

| | | | | |
|---|---|---|---|---|
| 4,569,475 | A * | 2/1986 | Cassidy | 229/146 |
| 4,729,508 | A * | 3/1988 | Erdmann et al. | 206/268 |
| 6,193,060 | B1 * | 2/2001 | Roberts et al. | 206/268 |
| D443,388 | S | 6/2001 | Roberts et al. | |
| 6,334,532 | B1 * | 1/2002 | Tambo et al. | 206/268 |
| D462,479 | S | 9/2002 | Draghetti | |
| 6,474,469 | B1 * | 11/2002 | Luton et al. | 206/268 |

FOREIGN PATENT DOCUMENTS

| | | |
|---|---|---|
| JP | 50-91485 A | 7/1975 |
| JP | 11-49149 A | 2/1999 |
| WO | WO-98/22367 A1 | 5/1998 |

* cited by examiner

*Primary Examiner*—Bryon P. Gehman
(74) *Attorney, Agent, or Firm*—Birch, Stewart, Kolasch and Birch, LLP

(57) ABSTRACT

A hinged-lid pack includes a case (2), and contents (14) contained in the case (2) and fit with an inner frame (16). The case (2) has a transverse cutting line (22) formed in a front wall (4) thereof, oblique cutting lines (24) respectively formed in right and left side walls (12) thereof, and a self-hinge (26) formed at a rear wall (6) thereof. When the case (2) is split apart along the transverse cutting line (22) and the oblique cutting lines (24), the case (2) is divided into a box (30) and a recloseable lid (28).

8 Claims, 8 Drawing Sheets

HINGED-LID PACK FOR RODLIKE SMOKING ARTICLES AND BLANK FOR THE PACK

This application is a Continuation of copending PCT International Application No. PCT/JP2004/000390 filed on Jan. 20, 2004, which designated the United States, and on which priority is claimed under 35 U.S.C. § 120. This application also claims priority under 35 U.S.C. § 119(a) on Patent Application No(s). 2003-011360 filed in Japan on Jan. 20, 2003. The entire contents of each of the above documents is hereby incorporated by reference.

TECHNICAL FIELD

The present invention relates to a hinged-lid pack for rodlike smoking articles such as cigarettes and filter cigarettes, and a blank for the hinged-lid pack.

BACKGROUND ART

This type of hinged-lid pack is disclosed in Unexamined Japanese Patent Publication No. H11-49149, for example. The pack disclosed in the publication includes a box having an open end, contents of the box, and a lid for closing the open end of the box. The box has an inner frame which forms a front edge and right and left side edges of the open end of the box. The lid is connected to the rear edge of the open end by a self-hinge. The lid is swung about the self-hinge to uncover the open end of the box.

The contents, on the other hand, include a bundle of rodlike smoking articles and a wrapper wrapping the bundle therein.

Usually, the hinged-lid pack is wrapped in a transparent wrapping film with a tear tape. Thus, to open the pack, first, the wrapping film must be torn by means of the tear tape to expose the lid of the pack.

The wrapping film has a side seam extending along a side surface of the pack, and closed surfaces respectively covering the top and bottom of the pack. Each closed surface is formed by folding part of the wrapping film and has closure flaps superposed one upon the other. The closure flaps are bonded together by heat seal.

The seal strength of the closure flaps is relatively low, so that the closure flaps can be easily separated from each other. Since the closure flaps can therefore be unfolded and then refolded, there is a possibility that the closed surface is undesirably unsealed. Once the closed surface is unsealed, the lid of the pack can be freely opened and closed, allowing a person to tamper with the contents of the pack.

The wrapping film is effective in maintaining the quality of the rodlike smoking articles in the pack for a long period of time. This form of wrapping the rodlike smoking articles is, however, tripe wrapping requiring the wrapper for the contents, the blank, and the wrapping film, and such triple wrapping structure is excessive in view of the recent trend for saving resources.

Further, the lid of an ordinary pack is relatively small and, when opened, does not allow a substantial part of the contents of the box, that is, the rodlike smoking articles, to be exposed. Accordingly, it is not easy to take out a rodlike smoking article from the box.

An object of the present invention is therefore to provide a hinged-lid pack of which the rodlike smoking articles are not excessively wrapped, yet can be effectively prevented from being tampered with, and also can be taken out with ease, and a blank for the hinged-lid pack.

DISCLOSURE OF THE INVENTION

A hinged-lid pack according to the present invention comprises: a boxlike case including a front wall, a rear wall, a top wall, a bottom wall, and right and left side walls; contents contained in the case, the contents having a bundle of rodlike smoking articles and a wrapper wrapping the bundle therein; an inner frame arranged inside the case, the inner frame having a front portion sandwiched between the front wall and the contents, side portions sandwiched between the respective side walls and the contents, and one of a generally U-shaped access opening formed in the front portion, opening toward the bottom wall and having a bottom located closer to the top wall than the center of the front wall, and an opening-forming area demarcated by a cutting line for forming the access opening; a transverse cutting line extending transversely across the front wall and permitting separation of the front wall, the transverse cutting line being located between the bottom of the access opening or a portion of the opening-forming area corresponding to the bottom and the top wall; an oblique cutting line extending obliquely across each of the side walls from the transverse cutting line toward the bottom wall and permitting separation of the corresponding side wall; and a self-hinge extending across the rear wall and interconnecting the oblique cutting lines of the respective side walls, the self-hinge being located closer to the bottom wall than the center of the rear wall, wherein, when the transverse cutting line and the oblique cutting lines are split apart, the case is divided into a box having the top wall and containing the contents, and a lid having the bottom wall and swingable about the self-hinge.

With this hinged-lid pack, when the case is split along the transverse and oblique cutting lines, the case is divided into the box and the lid. The lid is then swung about the self-hinge to be opened.

The transverse cutting line is located close to the top wall of the case; therefore, when the lid is opened, a substantial part of the front of the box is exposed. Moreover, the inner frame has a large access opening, and this makes it easy to take out a rodlike smoking article from the box.

The open posture of the pack greatly differs from those of ordinary hinged-lid packs and thus can make a strong impression on the smoker or people around the smoker.

Once the transverse and oblique cutting lines are split apart, traces of separation remain on the case, and such traces clearly indicate that the case has already been split open. Accordingly, the transverse and oblique cutting lines effectively serve to prevent the contents from being tampered with.

Before the case is split open, the contents are securely enclosed in the case, making it unnecessary to wrap the case in a film.

Preferably, the inner frame extends from the top wall to the bottom wall. In this case, the inner frame functions as a reinforcing member for the box.

Further, each side wall has a portion which is located closer to the top wall than the oblique cutting line and at which the side wall is bonded to the corresponding side portion of the inner frame. By bonding the side walls to the inner frame in this manner, it is possible to further increase the rigidity of the box.

Specifically, the rodlike smoking articles are filter cigarettes, and the contents are contained in the case in a manner such that the filters of the filter cigarettes are located at the bottom wall. In this case, the smoker pulls the lid toward him or her to open the box, unlike ordinary hinged-lid packs, and then takes out a filter cigarette from the box. The motions of opening the lid and withdrawing a filter cigarette lead to the smoker's elegant movements, which are especially fit for female smokers.

Preferably, the contents include upper and lower closed surfaces formed by folding the wrapper and covering both ends of the contents, respectively, a separable area formed as part of the wrapper demarcated by a separation line and having a shape corresponding to that of the access opening or the opening-forming area, and a glue-applied area bonding the separable area to an inner surface of the front wall through the access opening or the opening-forming area.

When the lid is opened for the first time, the separable area of the wrapper is separated along the separation line and the filter cigarettes of the contents are partly exposed through the access opening of the inner frame. Thus, after the lid is opened for the first time, the smoker need not remove the separable area from the wrapper. A separate piece is produced as a result of the separation of the separable area, but since the separate piece remains bonded to the inner surface of the lid, the smoker need not dispose of the separate piece.

Where the inner frame has the opening-forming area, the opening-forming area is separated from the inner frame when the lid is opened for the first time, thereby forming the access opening in the inner frame.

Preferably, the separable area further includes part of the lower closed surface of the contents. Specifically, the lower closed surface includes right and left end flaps, and inner and outer flaps successively superposed on the end flaps, and the outer flap is included in the separable area. In this case, the pack further includes a glue-applied area bonding the outer flap and an inner surface of the bottom wall to each other.

The present invention also provides a blank for forming the aforementioned case. The blank comprises: a rear panel for forming the rear wall of the case, the rear panel having opposite end edges, opposite side edges, and the self-hinge located close to one of the opposite end edges; a pair of inner side flaps connected to the respective side edges of the rear panel with a folding line therebetween; an inner cutting line obliquely extending across each of the inner side flaps; a first outer end panel connected to the other of the opposite end edges of the rear panel with a folding line therebetween, the first outer end panel having an end edge located opposite the rear panel; a pair of first inner end flaps located on both sides of the first outer end panel and connected to the respective inner side flaps with a folding line therebetween, the first inner end flaps forming the top wall of the case in cooperation with the first outer end panel; a second outer end panel connected to the one end edge of the rear panel with a folding line therebetween, the second outer end panel having an end edge located opposite the rear panel; a pair of second inner end flaps located on both sides of the second outer end panel and connected to the respective inner side flaps with a folding line therebetween, the second inner end flaps forming the bottom wall of the case in cooperation with the second outer end panel; a beam panel connected to the end edge of the first outer end panel with a folding line therebetween and having opposite side edges; a pair of beam side flaps connected to the respective side edges of the beam panel with a folding line therebetween; a front panel connected to the end edge of the second outer end panel with a folding line therebetween and forming the front wall of the case in cooperation with the beam panel, the front panel having opposite side edges; the transverse cutting line extending across the front panel; a pair of outer side flaps connected to the respective side edges of the front panel with a folding line therebetween and forming the side walls of the case in cooperation with the beam side flaps and the inner side flaps; and an outer cutting line obliquely extending across each of the outer side flaps, the outer cutting lines forming the oblique cutting lines of the case in cooperation with the inner cutting lines.

BEST MODE OF CARRYING OUT THE INVENTION

Figure 1:
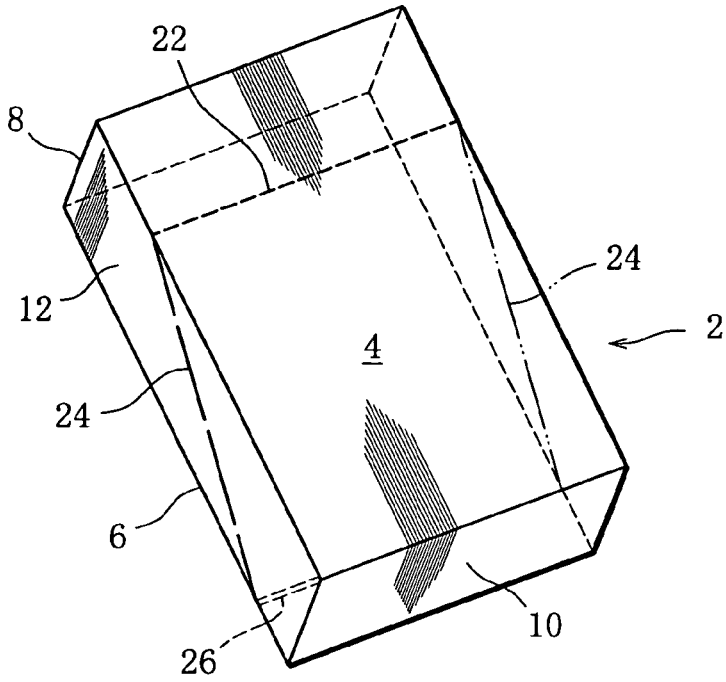
FIG. 1 is a perspective view showing a state of a hinged-lid pack of one embodiment which is not opened yet.

FIG. 1 shows a hinged-lid pack according to one embodiment of the present invention.

The pack comprises a case 2 in the form of a rectangular parallelepiped. The case 2 has a front wall 4, a rear wall 6, a top wall 8, a bottom wall 10, and right and left side walls 12.

Figure 2:
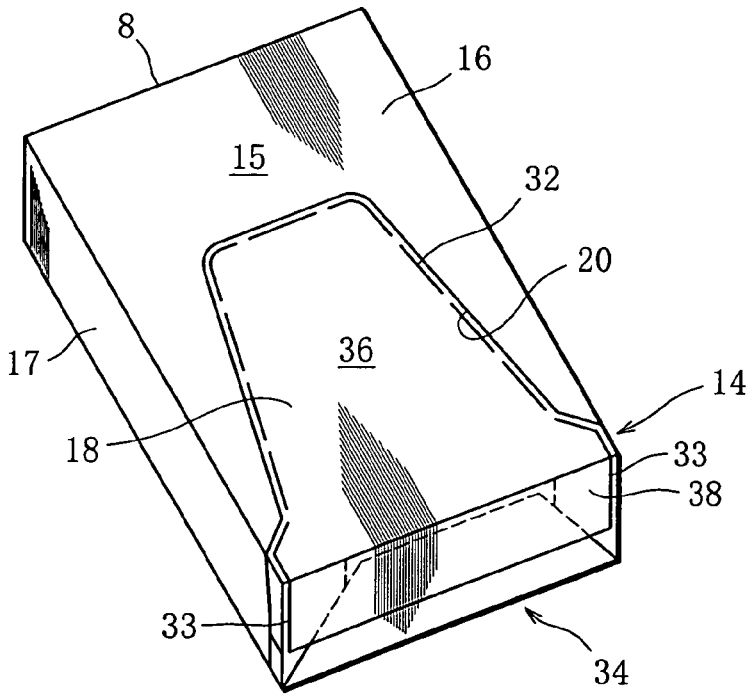
FIG. 2 is a perspective view showing contents of the pack of FIG. 1 together with an inner frame.

The case 2 contains therein contents 14 in the form of a rectangular parallelepiped, as shown in FIG. 2, together with an inner frame 16. The contents 14 include a bundle CB of 20 filter cigarettes and a wrapper 18 wrapping the cigarette bundle CB therein.

The inner frame 16 extends from the top wall 8 of the case 2 to the vicinity of the bottom wall 10. More specifically, the inner frame 16 has a front portion 15 superposed on the front surface of the contents 14, and right and left side portions 17 extending along the respective side surfaces of the contents 14.

The front portion 15 has an access opening 20. The access opening 20 is a generally U-shaped opening widening toward the bottom wall 10 of the case 2 and allows part of the front surface of the contents 14 to be exposed. As is clear from FIG. 2, the bottom edge of the access opening 20 is located closer to the top wall 8 than the center of the case 2, as viewed in the longitudinal direction of the case 20.

As shown in FIG. 1, the front wall 4 of the case 2 has a transverse cutting line 22. The transverse cutting line 22 is a row of perforations and extends transversely across the front wall 4 in parallel with the top wall 8. The transverse cutting line 22 is located closer to the top wall 8 than the bottom of the access opening 20.

Oblique cutting lines 24, which are each a row of slits, are formed in the right and left side walls 12 of the case 2, respectively. Each oblique cutting line 24 extends obliquely across the corresponding side wall 12 from the corresponding end of the transverse cutting line 22 toward the bottom wall 10.

The rear wall 6 of the case 2 has a self-hinge 26 formed by a folding line. The self-hinge 26 is located in the vicinity of the bottom wall 10 and extends across the rear wall 6 along the bottom wall 10. More specifically, the self-hinge 26 interconnects the right and left oblique cutting lines 24.

Figure 3:
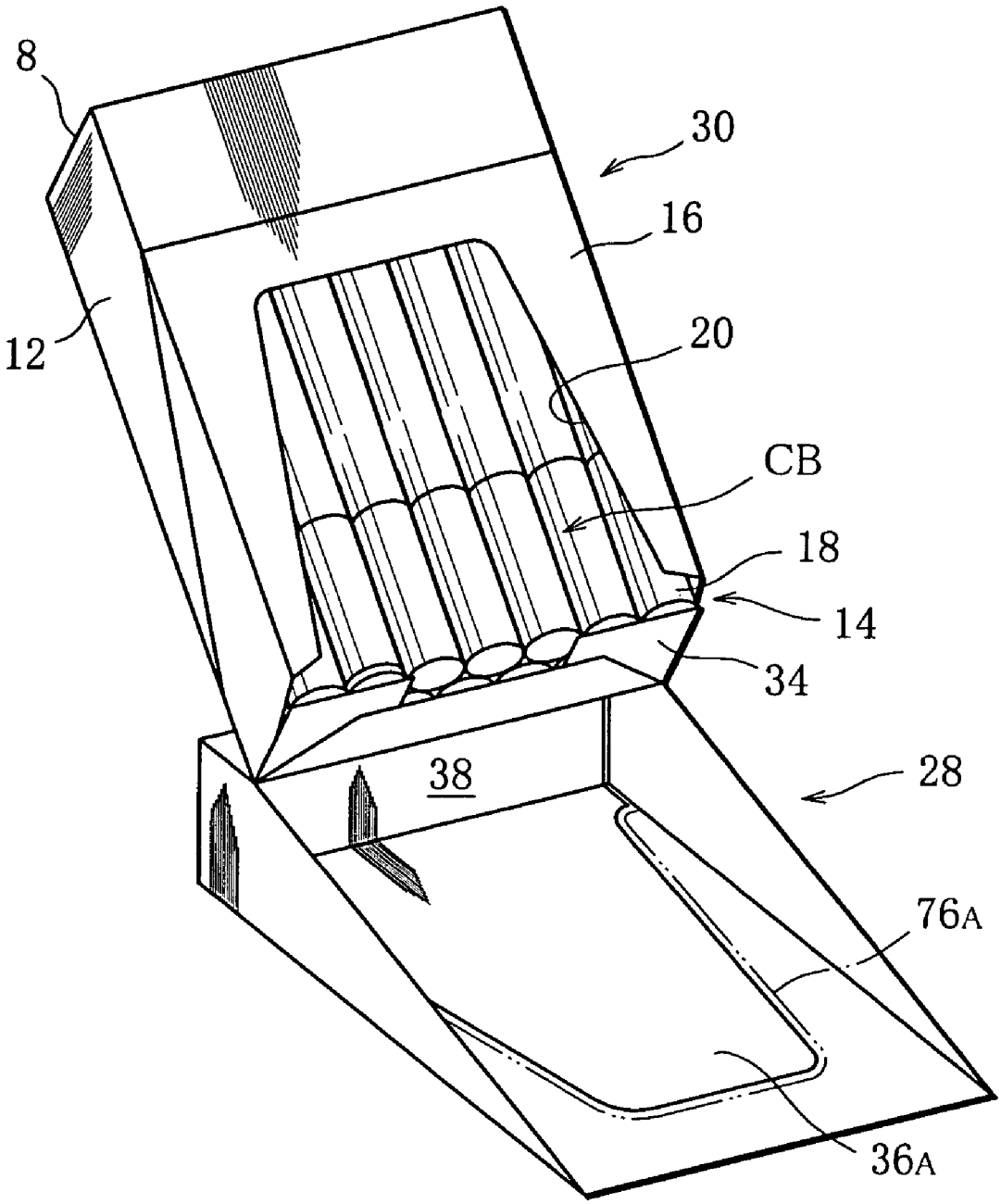
FIG. 3 is a perspective view showing an opened state of the pack of FIG. 1.

The transverse cutting line 22 permits separation of the front wall 4, and the right and left oblique cutting lines 24 permit separation of the respective side walls 12. Accordingly, when the case 2 is split open along the transverse cutting line 22 and the right and left oblique cutting lines 24, the case 2 is divided into a box 30 and a lid 28, as shown in FIG. 3. The box 30 and the lid 28 are connected to each other by the self-hinge 26.

The lid 28 includes part of the case 2, namely, a portion of the front wall 4 from the transverse cutting line 22 to the bottom wall 10, the bottom wall 10, a portion of the rear wall 6 from the bottom wall 10 to the self-hinge 26, and portions of the right and left side walls 12 continuous with the above portion of the front wall. On the other hand, the box 30 includes the remaining part of the case 2 and the aforementioned inner frame 16, and the contents 14 are accommodated in the box 30.

When the lid 28 is swung about the self-hinge 26, the case 2 opens wide, as clearly shown in FIG. 3. As a result, part of the cigarette bundle CB as the contents 14 is exposed through the access opening 20 of the inner frame 16.

More specifically, the wrapper 18 of the contents 14 has a separable area 36 as part thereof, as shown in FIG. 2, and the separable area 36 is demarcated by a separation line 32 and a pair of slits 33. The separation line 32, which is a row of slits, extends along the edge of the access opening 20 and defines a front portion of the separable area 36. The slits 33 are formed in a lower closed surface 34 of the contents 14 and extend from the respective ends of the separation line 32. The slits 33 allow an outer flap 38, which is part of the lower closed surface 34, to be connected only to the front portion of the separable area 36.

The separable area 36 is bonded in advance to the inner surface of the case 2, that is, the inner surface of the lid 28. Accordingly, when the lid 28 is swung open for the first time with the case 2 split apart, the separable area 36 is separated from the wrapper 18, thus producing a separate piece $\mathbf{36}_A$. The separate piece $\mathbf{36}_A$ remains bonded to the inner surface of the lid 28. As a result, the cigarette bundle CB of the contents 14 is exposed through the access opening 20 of the inner frame 16.

A procedure for wrapping the cigarette bundle CB in the wrapper 18 will be now explained.

First, the wrapper 18 is wound around the cigarette bundle CB, and the opposite ends thereof are superposed one upon the other on one side surface of the cigarette bundle CB. At this time, the wrapper 18 has two tubular portions respectively projecting from the upper and lower end faces of the cigarette bundle CB. Subsequently, the upper and lower tubular portions of the wrapper 18 are successively folded toward the respective upper and lower end faces of the cigarette bundle CB in predetermined form, thereby forming an upper closed surface and lower closed surface 34 of the contents 14. Specifically, each closed surface has right and left end flaps, an inner flap and the outer flap 38 successively superposed on the end flaps.

Figure 4:
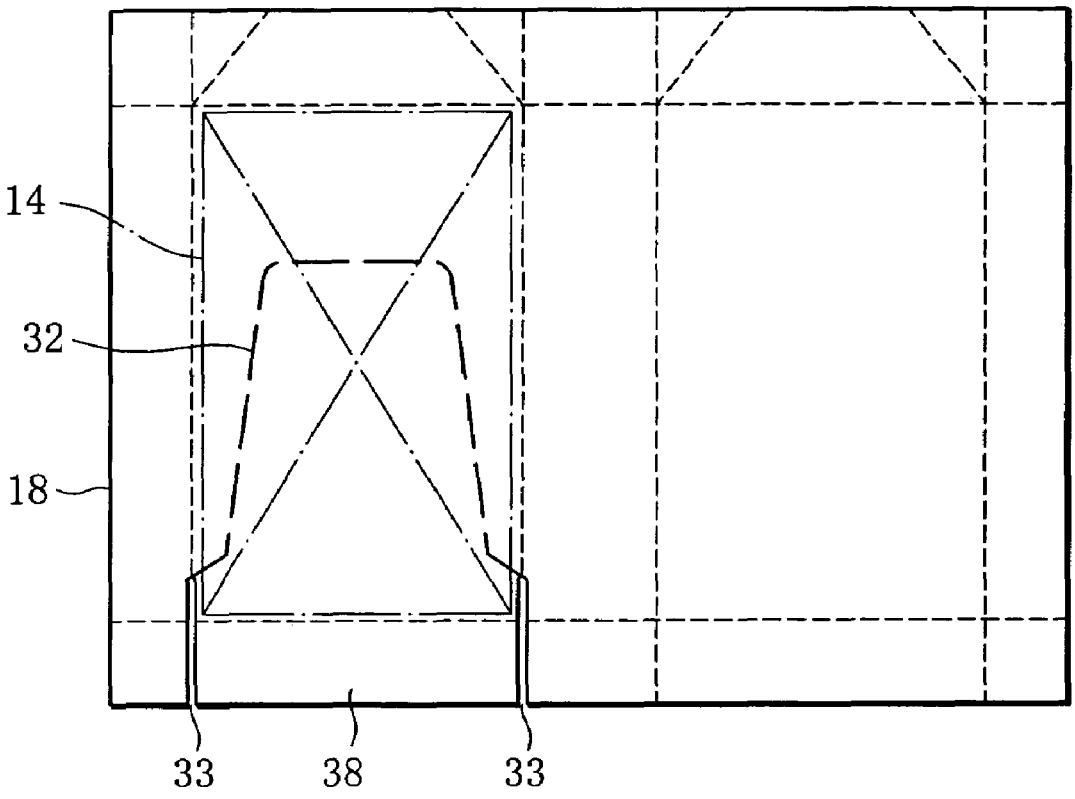
FIG. 4 illustrates an unfolded state of a wrapper for the contents shown in FIG. 2.

FIG. 4 shows an unfolded state of the wrapper 18. As is clear from FIG. 4, that portion of the wrapper 18 which is to form the outer flap 38 is continuous only with the portion (front portion of the separable area 36) demarcated by the separation line 32 and is separated by the slits 33 from the remaining portion of the wrapper 18. In FIG. 4, the broken lines indicate folding lines of the wrapper 18.

Each slit 33 of the outer flap 38 may alternatively be constituted by a separation line similar to the separation line 32.

Figure 5:
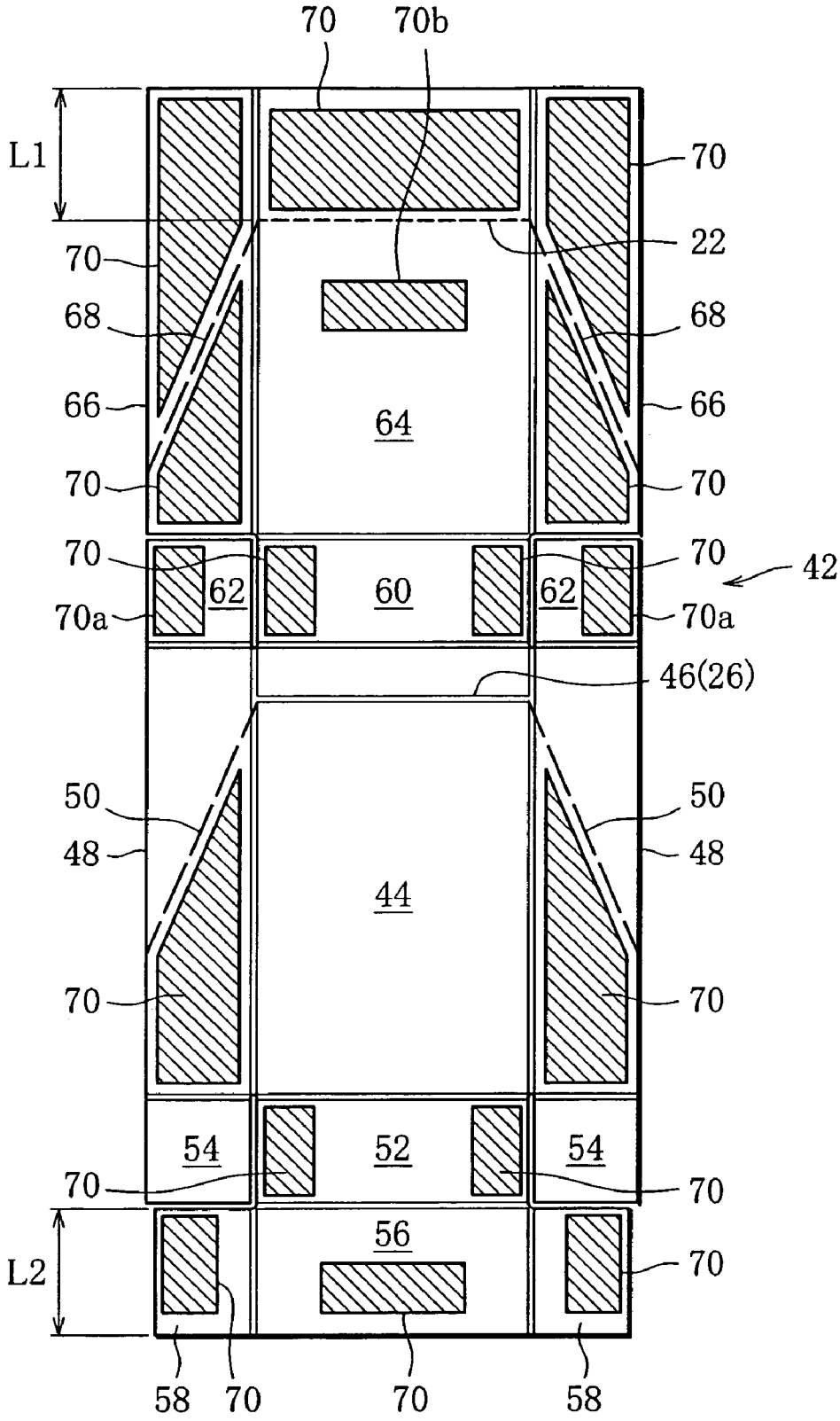
FIG. 5 shows a blank for forming the case of the pack of FIG. 1.

FIG. 5 shows the inside of a blank 42 for forming the aforementioned case 2. In the following, the blank 42 will be described in detail.

The blank 42 has a rear panel 44 for the rear wall 6, and the rear panel 44 has a bending line 46 for forming the self-hinge 26. A pair of inner side flaps 48 are connected to the opposite side edges of the rear panel 44 with a folding line therebetween and have inner cutting lines 50, respectively. The inner cutting lines 50 extend from the respective ends of the bending line 46 obliquely across the respective inner side flaps 48.

In FIG. 5, the bending line 46 and the above folding lines, as well as the other folding lines mentioned later, are all indicated by double lines.

A first outer end panel 52 is connected to the lower edge of the rear panel 44 with a folding line therebetween. First inner end flaps 54 are located on both sides of the first outer end panel 52, respectively, and are connected to the lower edges of the respective inner side flaps 48 with a folding line therebetween. The first inner end flaps 54 and the first outer end panel 52 are used for forming the top wall 8 of the case 2.

A beam panel 56 is connected to the lower edge of the first outer end panel 52 with a folding line therebetween. A pair of beam side flaps 58 are connected to the opposite side edges of the beam panel 56 with a folding line therebetween.

A second outer end panel 60 is connected to the upper edge of the rear panel 44 with a folding line therebetween, and second inner end flaps 62 are located on both sides of the second outer end panel 60, respectively. The second inner end flaps 62 are connected to the upper edges of the respective inner side flaps 48 with a folding line therebetween. The second inner end flaps 62 and the second outer end panel 60 are used for forming the bottom wall 10 of the case 2.

A front panel 64 is connected to the upper edge of the second outer end panel 60 with a folding line therebetween. The front panel 64 has the aforementioned transverse cutting line 22 extending transversely across the front panel 64. A length L1 between the upper edge of the front panel 64 and the transverse cutting line 22 is equal to the length L2 of the aforementioned beam panel 56. The front panel 64 and the beam panel 56 are used for forming the front wall 4 of the case 2.

Outer side flaps 66 are connected to the opposite side edges of the front panel 64 with a folding line therebetween and have outer cutting lines 68, respectively. The outer cutting lines 68 extend from the respective ends of the transverse cutting line 22 obliquely across the respective outer side flaps 66.

When the case 2 is formed, that is, when the inner and outer side flaps 48 and 66 are superposed one upon the other, the outer cutting lines 68 coincide with the respective inner cutting lines 50, thereby forming the oblique cutting lines 24 of the case 2. Also, in this case, the inner and outer side flaps 48 and 66 form the side walls 12 of the case 2 in cooperation with the beam side flaps 58.

On the inside of the blank 42, glue is applied to predetermined areas of the panels and flaps, and in FIG. 5, such glue-applied areas 70 are indicated by hatching.

Specifically, each inner side flap 48 has a glue-applied area 70 located only on a lower portion thereof than the inner cutting line 50, and the first outer end panel 52 has glue-applied areas 70 located on both sides thereof.

The beam panel 56 and the right and left beam flaps 58 each have a glue-applied area 70 located approximately at the center thereof.

The second outer end panel 60 has glue-applied areas 70 located on both sides thereof, and each second inner end flap 62 has a glue-applied area 70*a* located close to the outer side edge thereof. After the case 2 is formed, the glue-applied areas 70*a* of the second inner end flaps 62 adhere to respective side portions of the outer flap 38.

The front panel 64 has glue-applied areas 70 located above and below the transverse cutting line 22, respectively. After the case 2 is formed, the lower glue-applied area 70*b* of the front panel 64 adheres to the contents 14 through the access opening 20 of the inner frame 16.

Each outer side flap 66 has a glue-applied area 70 extending over an entire surface thereof except the outer cutting line 68.

The functions of the glue-applied areas 70 will become apparent from the following explanation of a pack production process with reference to FIGS. 6 through 11.

Figure 6:
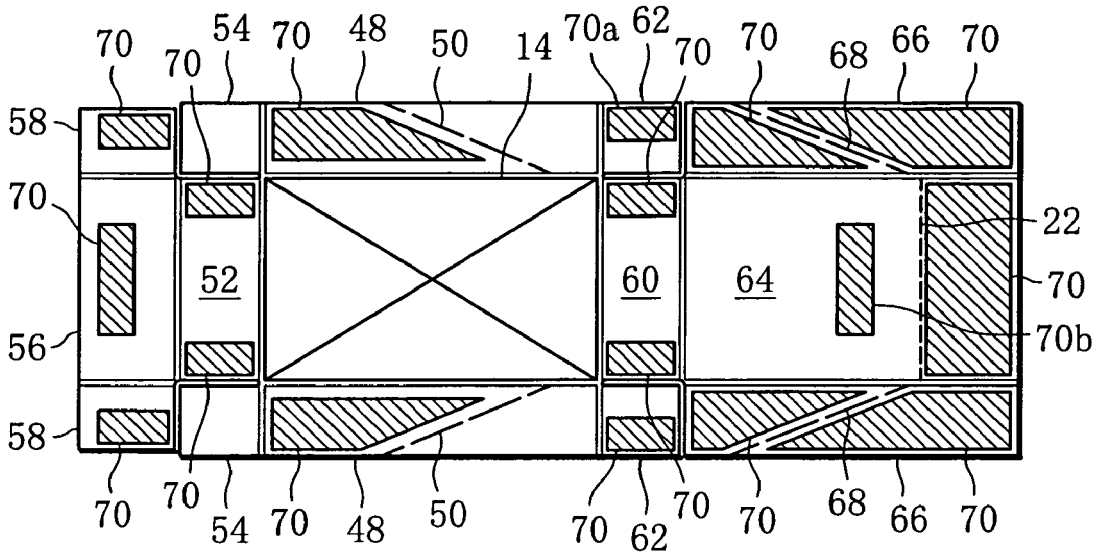
FIGS. 6 through 11 illustrate a process of folding up the blank shown in FIG. 5.

As shown in FIG. 6, first, the contents 14 are placed on the rear panel 44 of the blank 42. At this time, the contents 14 are oriented such that the filters of the cigarette bundle CB face the side of the second outer end panel 60.

Also, the contents 14 are fit with the inner frame 16 before being fed onto the blank 42. In FIGS. 6 to 11, the inner frame 16 is not shown.

Figure 7:
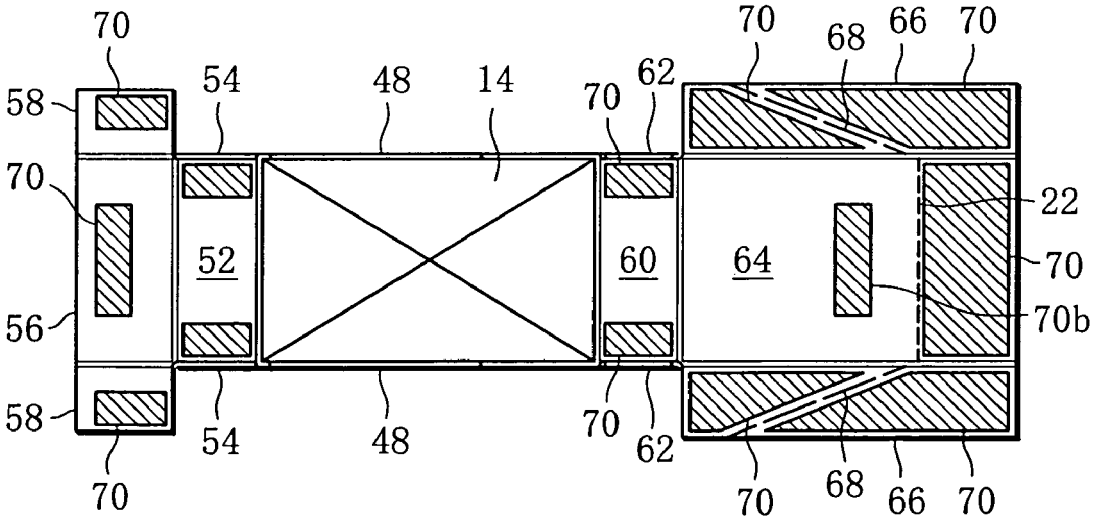

Subsequently, as shown in FIG. 7, the inner side flaps 48 are bent, together with the first and second inner end flaps 54 and 62, toward the respective side surfaces of the contents 14 and superposed thereon. Thus, the inner side flaps 48 are bonded at their glue-applied areas 70 to the respective side surfaces of the contents 14, that is, the inner frame 16. Each inner side flap 48 has the glue-applied area 70 formed only on a limited portion thereof located between the inner cutting line 50 and the first outer end panel 52, and therefore, the remaining portion of each inner side flap 48 does not adhere to the corresponding side surface of the inner frame 16.

Figure 8:
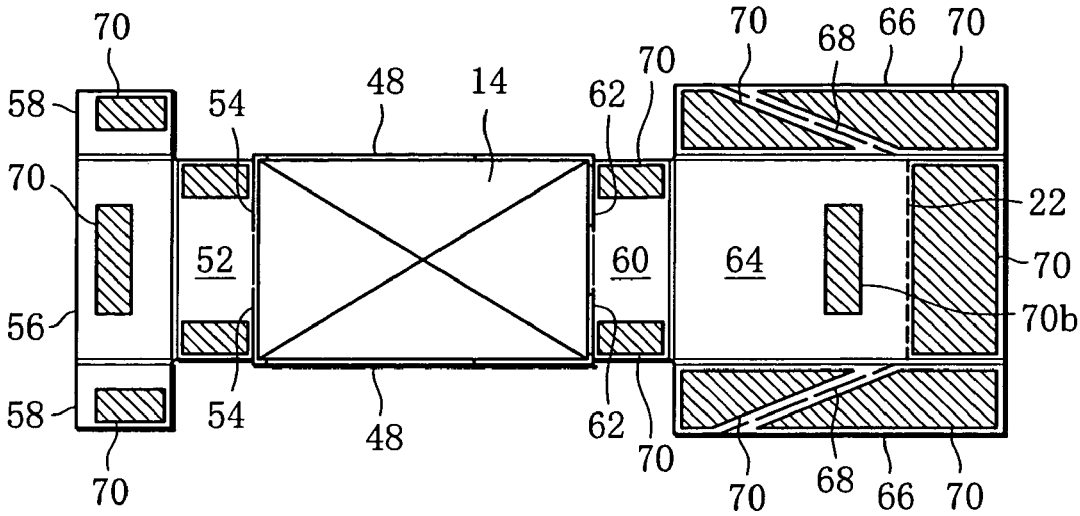

Then, as shown in FIG. 8, the first and second inner end flaps 54 and 62 are bent toward the upper and lower closed surfaces of the contents 14, respectively, and are superposed thereon. At this time, the first inner end flaps 54 are bonded at their glue-applied areas 70 to the upper closed surface of the contents 14, and the second inner end flaps 62 are bonded at their glue-applied areas 70*a* to the outer flap 38 of the lower closed surface 34 of the contents 14.

Subsequently, the first outer end panel 52 is bent, together with the beam panel 56 and the right and left beam flaps 58, toward the upper closed surface of the contents 14 and superposed thereon. Thus, the first outer end panel 52 is bonded at its right and left glue-applied areas 70 to the respective first inner end flaps 54 which are already bent. At this point of time, the top wall 8 of the case 2 is formed by the panel 52 and the flaps 54.

Figure 9:
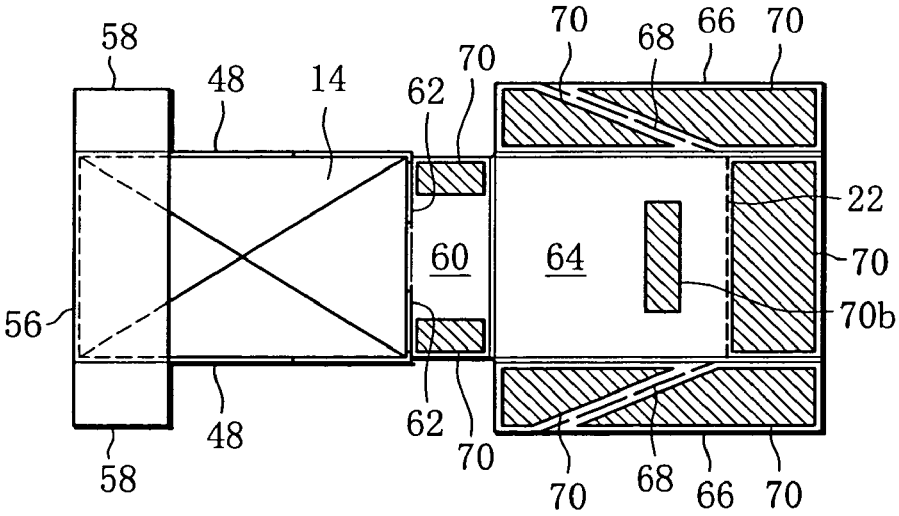

The beam panel 56 is then bent, together with the right and left beam flaps 58, toward the upper surface of the contents 14 and superposed thereon, as shown in FIG. 9. Thus, the beam panel 56 is bonded at its glue-applied area 70 to the inner frame 16 of the contents 14. At this stage, the right and left beam flaps 58 project sideways from the respective inner side flaps 48.

Figure 10:
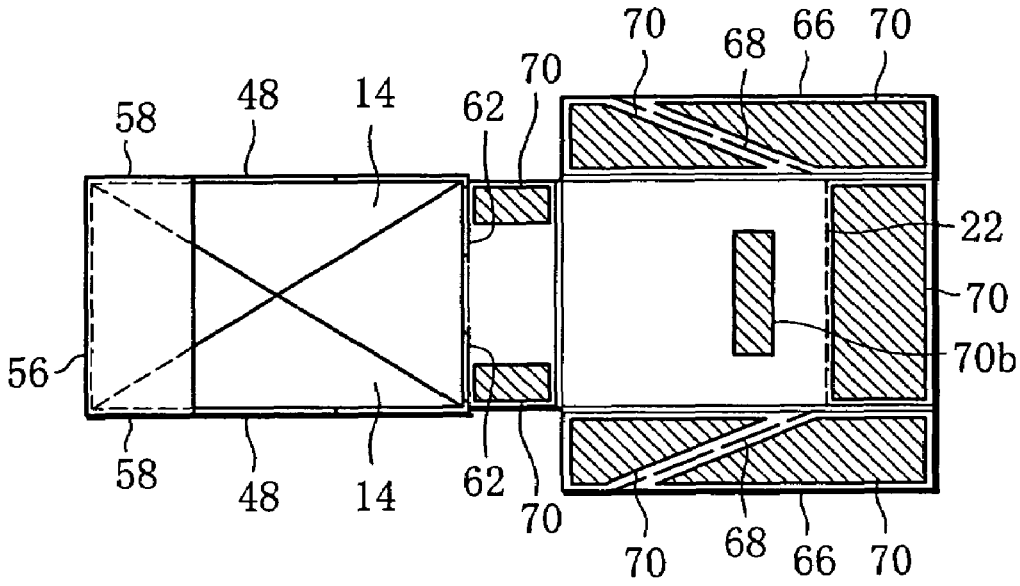

Then, as shown in FIG. 10, the right and left beam flaps 58 are bent toward the respective inner side flaps 48 and superposed thereon. Thus, the beam side flaps 58 are bonded at their glue-applied areas 70 to the respective inner side flaps 48.

Subsequently, the second outer end panel 60 is bent, together with the front panel 64 and the right and left outer side flaps 66, toward the lower closed surface 34 of the contents 14 and superposed thereon. Thus, the second outer end panel 60 is bonded at its glue-applied areas 70 to the second inner end flaps 62 which are already bent. At this point of time, the bottom wall 10 of the case 2 is formed by the end panel 60 and the end flaps 62.

The front panel 64 is then bent, together with the right and left outer side flaps 66, toward the upper surface of the contents 14 and superposed on the already bent beam panel 56 and the inner frame 16. Thus, the front panel 64 is bonded at its glue-applied area 70 to the beam panel 56 and is also bonded at its glue-applied area 70*b* to the separable area 36 of the contents 14 through the access opening 20 of the inner frame 16.

Figure 11:
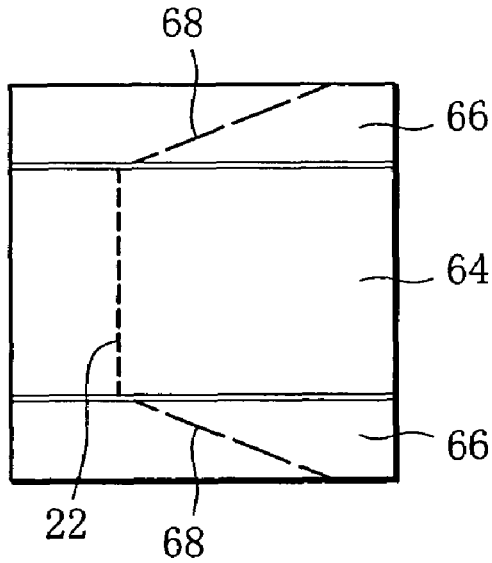

This state is shown in FIG. 11. At this point of time, the front wall 4 of the case 2 is formed by the front panel 64 and the beam panel 56. Also, at this stage, the transverse cutting line 22 coincides with the edge of the beam panel 56, and the right and left outer side flaps 66 project sideways from the front panel 64.

Subsequently, the right and left outer side flaps 66 are bent toward the respective inner side flaps 48 and superposed thereon. Thus, each outer side flap 66 is bonded, at its glue-applied area 70 extending over the entire surface thereof except the outer cutting line 68, to the corresponding inner side flap 48. At this point of time, the side walls 12 of the case 2 are formed by the side flaps 48 and 66, thus obtaining the case 2 shown in FIG. 1.

When the side walls 12 are formed, the outer cutting lines 68 of the outer side flaps 66 coincide with the respective inner cutting lines 50 of the inner side flaps 48, thereby forming the oblique cutting lines 24.

As is clear from the above description, when the case 2 is produced, the separable area 36 of the contents 14 (wrapper 18) is bonded to the inner surfaces of the front wall 4 and bottom wall 10 by means of the glue-applied areas 70*a* and 70*b*.

Also, the side walls 12 of the case 2 are only partly bonded to the respective side surfaces of the inner frame 16. More specifically, the portion of each side wall 12 located between the oblique cutting line 24 and the top wall 8 is bonded to the corresponding side surface of the inner frame 16 through the glue-applied area 70 of the inner side flap 48 (see FIG. 5), but the portion of the side wall 12 located between the oblique cutting line 24 and the bottom wall 10 is not bonded to the side surface of the inner frame 16.

Accordingly, when the case 2 is split apart along the transverse cutting line 22 and the right and left oblique cutting lines 24 and thus divided into the lid 28 and the box 30, the lid 28 is in a free state relative to the box 30 and is swingable about the self-hinge 26 of the rear wall 6.

When the lid 28 is swung thereafter to open the case 2 wide, as shown in FIG. 3, the separable area 36 of the contents 14 (wrapper 18) is separated along the separation line 32, allowing the cigarette bundle CB of the contents 14 to be exposed through the access opening 20 of the inner frame 16.

Consequently, after opening the case 2, the smoker can instantly take out a filter cigarette from the box 30, without the need to remove the separable area 36.

The separate piece $\mathbf{36}_A$ (see FIG. 3) produced as a result of the separation of the separable area 36 remains bonded to the inner surface of the lid 28 by the glue-applied areas 70*a* and 70*b*. It is therefore unnecessary to dispose of the separate piece $36_A$, and after the contents 14 are used up, the separate piece $36_A$ is discarded together with the case 2.

The transverse cutting line 22 of the case 2 is located close to the top wall 8 and also the bottom of the access opening 20 of the inner frame 16 is located in the vicinity of the transverse cutting line 22, so that the front portion of the lid 28 is large as compared with those of the lids of ordinary hinged-lid packs. When the lid 28 is swung open, therefore, a substantial part of the front of the box 30 is exposed, as clearly shown in FIG. 3. Also, since the access opening 20 of the inner frame 16 has a large opening area, a filter cigarette can be taken out with ease. The open posture of the pack, shown in FIG. 3, markedly differs from those of ordinary packs and thus can make a strong impression on the smoker or people around the smoker. As is clear from FIG. 3, the cigarette bundle CB is contained in the case 2 in a manner such that the filters thereof face the bottom wall 10. This allows the smoker to swing the lid 28 open toward him or her by pulling the lid 28 apart from the box 30 and to pull out a filter cigarette toward him or her. Compared with the case of ordinary hinged-lid packs, these motions of opening the lid 28 and withdrawing a filter cigarette lead to the smoker's elegant movements, which are especially fit for female smokers.

Once the case 2 is divided into the lid 28 and the box 30, the transverse cutting line 22 and the oblique cutting lines 24 leave traces of separation on the case 2 and thus are useful in preventing the contents 14 from being tampered with.

The lid 28 cannot be opened or closed until the case 2 is divided, and thus film wrapping for the case 2 is unnecessary. This not only serves to cut the cost of film wrapping but greatly contributes to the reduction of waste because no film needs to be disposed of.

Further, the end portion of the case 2 on the same side as the top wall 8 includes the beam panel 56 with the right and left beam flaps 58 as well as the inner frame 16 and thus is high in strength.

Also, at the top wall-side end portion of the case, the beam panel 56 and the beam side flaps 58 are bonded at their glue-applied areas 70 to the inner frame 16, the beam side flaps 58 are also bonded to the inner side flaps 66 by means of the glue-applied areas 70, and the first outer end panel 52 is bonded at its glue-applied areas 70 to the right and left first inner end flaps 54. This form of bonding serves to improve the sealing performance of the top wall-side end portion of the case.

On the other hand, at the end portion of the case 2 on the same side as the bottom wall 10, the second outer end panel 60 is bonded at its glue-applied areas 70 to the right and left second inner end flaps 62, which are in turn bonded at their glue-applied areas 70*a* to the lower closed surface 34 (outer flap 38). Thus, the bottom wall-side end portion of the case also has high sealing performance. In consequence, the case 2 can maintain the quality of the filter cigarettes as the contents 14 over a long period of time, despite the omission of film wrapping.

The present invention is not limited to the foregoing embodiment and may be modified in various ways.

Figure 12:
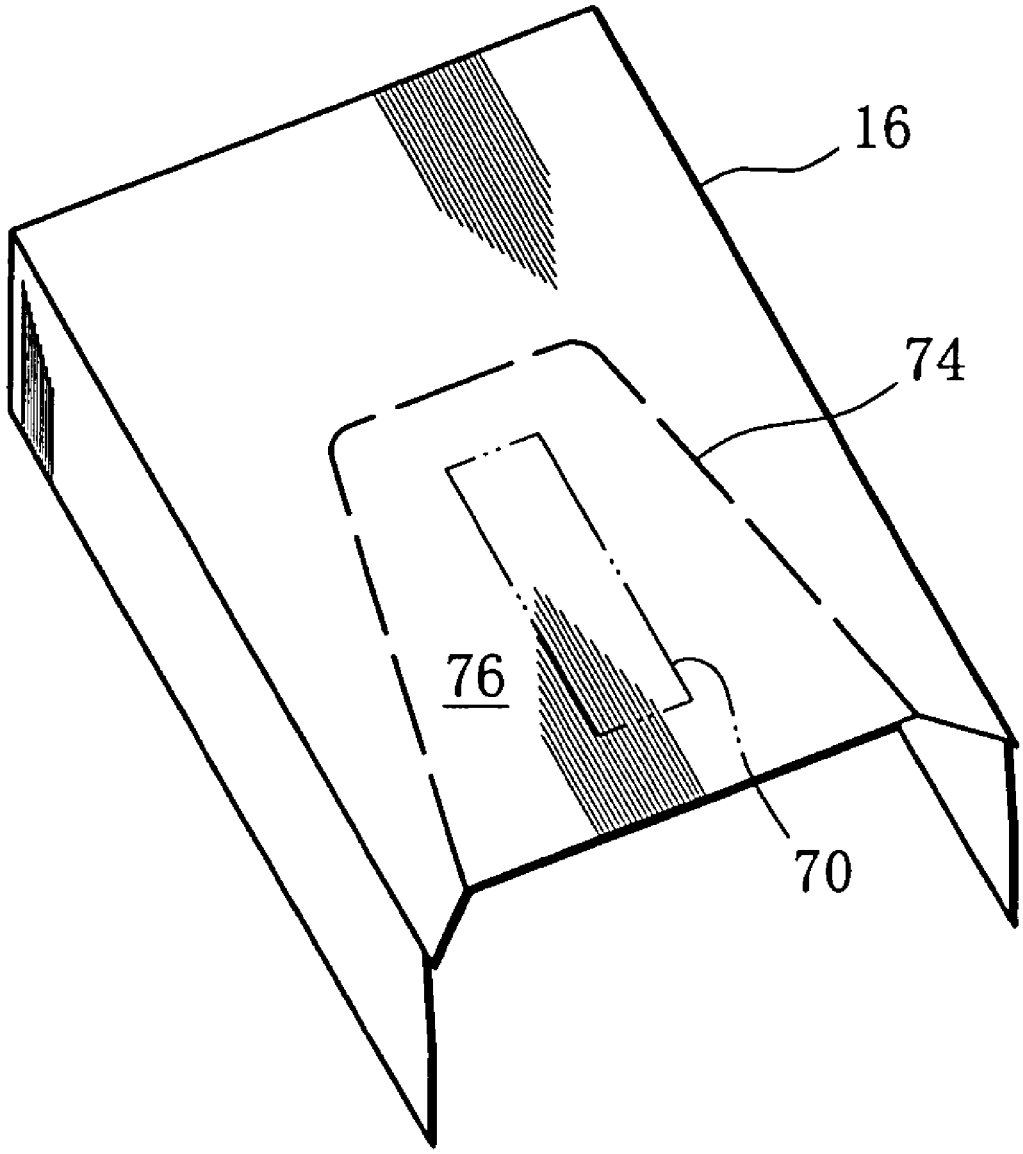
FIG. 12 is a perspective view showing a modification of the inner frame.

As shown in FIG. 12, the inner frame 16 may have an opening-forming area 76 for forming the access opening 20, instead of the access opening 20. The opening-forming area 76 is demarcated by a U-shaped cutting line 74. When the case 2 is produced, the inside and outside of the opening-forming area 76 are bonded at the glue-applied areas 70 to the separable area 36 of the wrapper 18 and the front panel 64, respectively.

When the lid 28 is opened for the first time with the case 2 split apart, both of the separable area 36 of the contents 14 and the opening-forming area 76 of the inner frame 16 are cut off, thereby forming the aforementioned access opening 20 in the inner frame 16. In this case, a cut piece $76_A$ (see FIG. 3) produced as a result of the separation of the opening-forming area 76 remains bonded to the inner surface of the lid 28 together with the separate piece $36_A$. The separable area 36 of the wrapper 18 may be used in such a way that information is printed on the inside thereof. In this case, when the lid 28 is opened, the information appears on the inner surface of the lid 28.

The invention claimed is:

1. A hinged-lid pack for rod-shaped smoking articles, comprising:

a box-shaped case including a front wall, a rear wall, a top wall, a bottom wall, and right and left side walls;

contents contained in said case, said contents having a bundle of rod-shaped smoking articles and a wrapper wrapping the bundle therein;

an inner frame arranged inside said case, said inner frame having a front portion sandwiched between the front wall and the contents, side portions sandwiched between the respective side walls and said contents, and one of a generally U-shaped access opening formed in the front portion, opening toward the bottom wall and having a bottom located closer to the top wall than the center of the front wall, and an opening-forming area demarcated by a cutting line for forming the access opening;

a transverse cutting line extending transversely across the front wall and permitting separation of the front wall, said transverse cutting line being located between the bottom of the access opening or a portion of the opening-forming area corresponding to the bottom and the top wall;

an oblique cutting line extending obliquely across each of the side walls from said transverse cutting line toward the bottom wall and permitting separation of the corresponding side wall; and a self-hinge extending across the rear wall and interconnecting said oblique cutting lines of the respective side walls, said self-hinge being located closer to the bottom wall than the center of the rear wall, wherein, when said transverse cutting line and a respective oblique cutting line are split apart, said case is divided into a box having the top wall and containing said contents, and a lid having the bottom wall and swingable about said self-hinge.

2. The hinged-lid pack according to claim 1, wherein said inner frame extends from the top wall to the bottom wall.

3. The hinged-lid pack according to claim 2, wherein each of the side walls has a portion which is located closer to the top wall than its said oblique cutting line and at which the side wall is bonded to the corresponding side portion of said inner frame.

4. The hinged-lid pack according to claim 1, wherein the rod-shaped smoking articles comprise filter cigarettes, and said contents are contained in said case in a manner such that filters of the filter cigarettes are located at the bottom wall.

5. The hinged-lid pack according to claim 4, wherein said contents include upper and lower closed surfaces formed by folding the wrapper and covering both ends of said contents, respectively, a separable area formed as part of the wrapper demarcated by a separation line and having a shape corresponding to that of the access opening or the opening-forming area, and a glue-applied area bonding the separable area to an inner surface of the front wall through the access opening or the opening-forming area.

6. The hinged-lid pack according to claim 5, wherein the separable area further includes part of the lower closed surface.

7. The hinged-lid pack according to claim 6, wherein the lower closed surface includes right and left end flaps, and inner and outer flaps successively superposed on the end flaps, the outer flap constituting part of the separable area, and the hinged-lid pack further includes a glue-applied area bonding the outer flap and an inner surface of the bottom wall to each other.

8. A blank for forming the case of claim 1, the blank comprising:

a rear panel for forming the rear wall of said case, said rear panel having opposite end edges, opposite side edges, and said self-hinge located close to one of the opposite end edges;

a pair of inner side flaps connected to the respective side edges of said rear panel with a folding line therebetween;

an inner cutting line obliquely extending across each of said inner side flaps;

a first outer end panel connected to the other of the opposite end edges of said rear panel with a folding line therebetween, said first outer end panel having an end edge located opposite said rear panel;

a pair of first inner end flaps located on both sides of said first outer end panel and connected to said respective inner side flaps with a folding line therebetween, said first inner end flaps forming the top wall of said case in cooperation with said first outer end panel;

a second outer end panel connected to the one end edge of said rear panel with a folding line therebetween, said second outer end panel having an end edge located opposite said rear panel;

a pair of second inner end flaps located on both sides of said second outer end panel and connected to said respective inner side flaps with a folding line therebetween, said second inner end flaps forming the bottom wall of said case in cooperation with said second outer end panel;

a beam panel connected to the end edge of said first outer end panel with a folding line therebetween and having opposite side edges;

a pair of beam side flaps connected to the respective side edges of said beam panel with a folding line therebetween;

a front panel connected to the end edge of said second outer end panel with a folding line therebetween and forming the front wall of said case in cooperation with said beam panel, said front panel having opposite side edges;

the transverse cutting line extending across said front panel;

a pair of outer side flaps connected to the respective side edges of said front panel with a folding line therebetween and forming the side walls of said case in cooperation with said beam side flaps and said inner side flaps; and an outer cutting line obliquely extending across each of said outer side flaps, said outer cutting lines forming the oblique cutting lines of said case in cooperation with said inner cutting lines.

* * * * *